US010599076B2

(12) United States Patent
Hasegawa

(10) Patent No.: US 10,599,076 B2
(45) Date of Patent: Mar. 24, 2020

(54) IMAGE FORMING APPARATUS AND CONTROL PROGRAM FOR IMAGE FORMING APPARATUS

(71) Applicant: KONICA MINOLTA, INC., Chiyoda-ku, Tokyo (JP)

(72) Inventor: Satoshi Hasegawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/031,643

(22) Filed: Jul. 10, 2018

(65) Prior Publication Data

US 2019/0025738 A1 Jan. 24, 2019

(30) Foreign Application Priority Data

Jul. 18, 2017 (JP) ..... 2017-138894

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053; G03G 15/2046; G03G 15/205; G03G 15/53
See application file for complete search history.

(56) References Cited

U.S. PATENT DOCUMENTS

| | | | | |
|---|---|---|---|---|
| 8,073,352 | B2 * | 12/2011 | Kunii | G03G 15/5004 399/69 |
| 8,682,192 | B2 * | 3/2014 | Ikebuchi | G03G 15/2039 399/67 |
| 8,886,064 | B2 * | 11/2014 | Fujimoto | G03G 15/205 399/33 |
| 9,632,464 | B2 | 4/2017 | Shiki et al. | |
| 10,156,820 | B2 * | 12/2018 | Ishii | G03G 15/2039 |
| 10,168,651 | B2 * | 1/2019 | Kato | G03G 15/2039 |
| 2010/0239301 | A1 * | 9/2010 | Nemoto | G03G 15/2039 399/69 |
| 2016/0124356 | A1 * | 5/2016 | Tamada | G03G 15/2039 399/70 |
| 2016/0230059 | A1 | 8/2016 | Takahashi et al. | |

FOREIGN PATENT DOCUMENTS

| | | | |
|---|---|---|---|
| JP | 2016069371 | A | 5/2016 |
| JP | 2016212259 | A | 12/2016 |

* cited by examiner

*Primary Examiner* — Walter L Lindsay, Jr.
*Assistant Examiner* — Arlene Heredia
(74) *Attorney, Agent, or Firm* — Holtz, Holtz & Volek PC

(57) ABSTRACT

An image forming apparatus includes: a fixer including a halogen heater; and a hardware processor that controls power supplied to the halogen heater, wherein the hardware processor switches, according to a state of the fixer, a control state for controlling the power supplied to the halogen heater between a first control state in which a lower limit of an amount of power per cycle of the power supplied to the halogen heater is set to a first value and a second control state in which the lower limit of the amount of power per cycle of the power supplied to the halogen heater is set to a second value lower than the first value.

11 Claims, 16 Drawing Sheets

IMAGE FORMING APPARATUS AND CONTROL PROGRAM FOR IMAGE FORMING APPARATUS

The entire disclosure of Japanese patent Application No. 2017-138894, filed on Jul. 18, 2017, is incorporated herein by reference in its entirety.

BACKGROUND

Technological Field

The present invention relates to an image forming apparatus and a control program for the image forming apparatus. More specifically, the present invention relates to an image forming apparatus including a fixer having a halogen heater, and a control program for the image forming apparatus.

Description of the Related Art

An electrophotographic image forming apparatus includes, for example, a multi-function peripheral (MFP) having a scanner function, a facsimile function, a copying function, a printer function, a data communication function, and a server function; a facsimile machine; a copying machine; and a printer.

An image forming apparatus generally forms an image on a sheet by the following method. The image forming apparatus forms an electrostatic latent image on an image bearing member and develops the electrostatic latent image using a developing device to form a toner image. Next, the image forming apparatus transfers the toner image to a sheet of paper and fixes the toner image on the sheet by a fixing device. Some image forming apparatuses form a toner image on a photoreceptor, transfer the toner image to an intermediate transfer belt using a primary transfer roller, and secondarily transfer the toner image on the intermediate transfer belt to a sheet of paper using a secondary transfer roller.

The fixing device is controlled to be heated by energizing a halogen heater (turning on the halogen heater) when the temperature of the fixing device is lower than a target controlled temperature, and to be de-energized (turning off the halogen heater) when the temperature of the fixing device is higher than the target controlled temperature. Under this control, the temperature of the fixing device follows the switching on and off of the halogen heater after a delay, so that the temperature of the fixing device continues to rise for a short time after the halogen heater is turned off. This causes ripple or variation in the temperature of the fixing device when the halogen heater is switched off.

Generally, the target controlled temperature of the fixing device is set to a high value, for example, immediately before introducing a first sheet into the fixing device, so that the difference is reduced between the target controlled temperature of the fixing device and the temperature at which a high-temperature abnormality of the fixing device is detected. Under such circumstances, ripple in the temperature of the fixing device may increase the chance of falsely detecting the high-temperature abnormality, and thus it has been required to suppress the ripple in the temperature of the fixing device.

JP 2016-212259 A discloses a technique of causing the temperature of a heating roller of a fixer to converge to a target control temperature at an early stage when an image forming operation is started and of reducing undershoot, overshoot, and temperature ripple. In an image forming apparatus disclosed in JP 2016-212259 A, when the image forming operation is started from a standby state, power is supplied to a heater by switching to a first fixing control for turning on and off the heater that heats the heating roller at a fixed duty ratio based on the detected temperature of the heating roller. Then, when it is detected that the reduced detected temperature has reached a lower limit at which the detected temperature starts to rise, power is supplied to the heater by switching to a second fixing control for changing the duty ratio according to the temperature difference between the detected temperature and the target control temperature. In the technique disclosed in JP 2016-212259 A, when the duty ratio is too low (when the amount of power supplied to the heater is too low), the halogen cycle may cease to operate normally and the life of the heater may be shortened.

JP 2016-069371 A discloses an image forming apparatus that is capable of inhibiting the decrease in the life of a heater caused by the above-mentioned reason. This image forming apparatus calculates the amount of power supplied to the halogen heater for each cycle of pulse width modulation (PWM) control and controls the flow of current to the halogen heater by PWM control such that the calculated amount of power is equal to or greater than a predetermined lower limit inherent to the halogen heater.

However, in the technique of JP 2016-069371 A, since the flow of current to the halogen heater by PWM control is controlled such that the calculated amount of power is always equal to or greater than the predetermined lower limit, the ripple in the temperature of the fixing device cannot be suppressed sufficiently.

SUMMARY

The present invention aims to solve the above problem, and it is an object of the present invention to provide an image forming apparatus that is capable of inhibiting decrease in the life of a halogen heater and of suppressing ripple in the temperature of a fixing device, and to provide a control program for the image forming apparatus.

To achieve the abovementioned object, according to an aspect of the present invention, an image forming apparatus reflecting one aspect of the present invention comprises: a fixer including a halogen heater; and a hardware processor that controls power supplied to the halogen heater, wherein the hardware processor switches, according to a state of the fixer, a control state for controlling the power supplied to the halogen heater between a first control state in which a lower limit of an amount of power per cycle of the power supplied to the halogen heater is set to a first value and a second control state in which the lower limit of the amount of power per cycle of the power supplied to the halogen heater is set to a second value lower than the first value.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiments, an image forming apparatus will be described as an MFP. The image forming apparatus may be a device other than an MFP, for example, a facsimile machine, a copying machine, or a printer.

First Embodiment

The configuration of an image forming apparatus according to the present embodiment will first be described.

Figure 1:
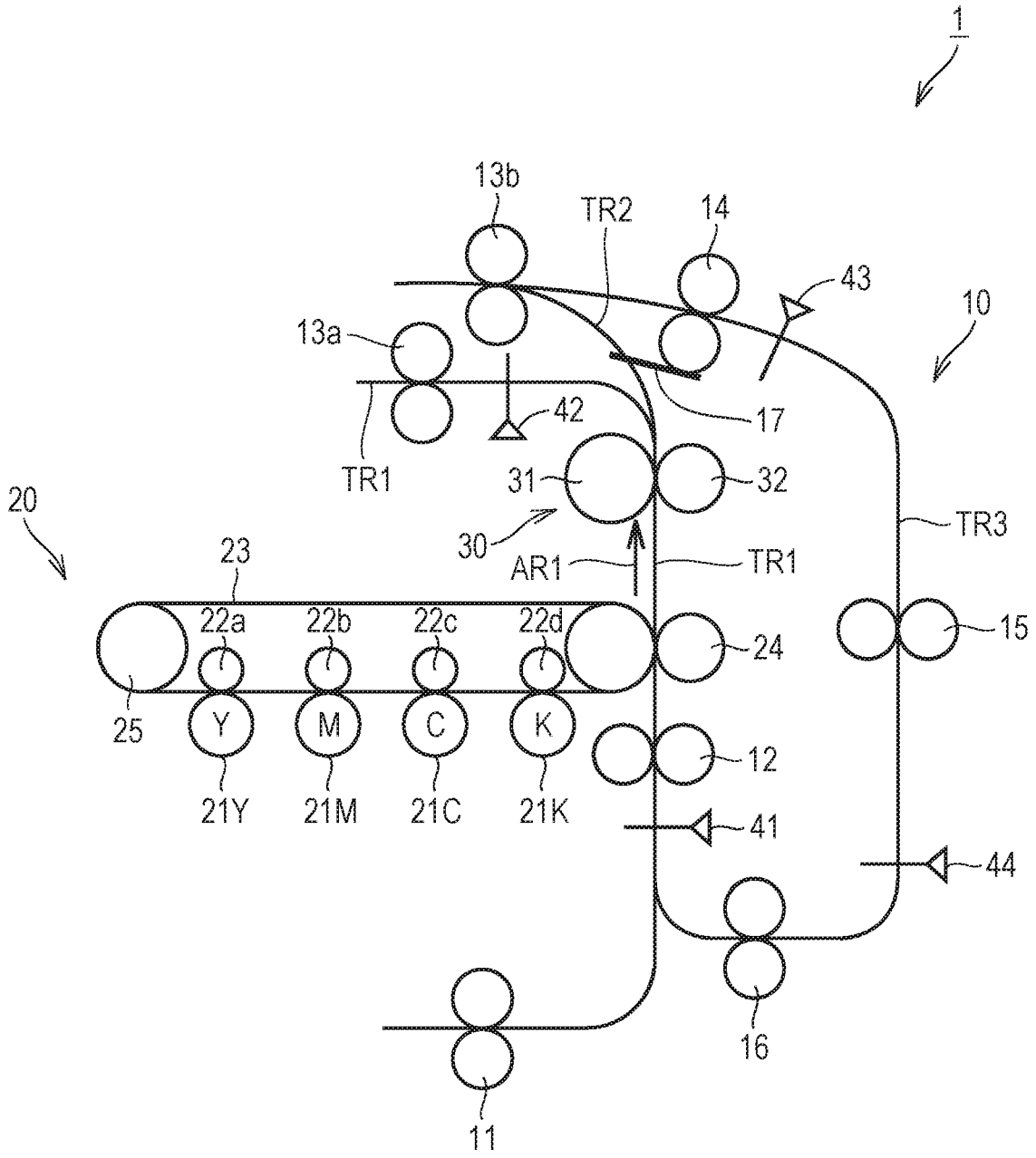
FIG. 1 is a cross-sectional view schematically showing a configuration of a color tandem type image forming apparatus according to a first embodiment of the present invention.

FIG. 1 is a cross-sectional view schematically showing the configuration of a color tandem type image forming apparatus 1 according to a first embodiment of the present invention. It should be noted that arrow AR1 in FIG. 1 indicates a conveying direction (conveying direction in a conveying path TR1) of a recording medium on which printing is performed by the image forming apparatus 1.

Referring to FIG. 1, the image forming apparatus 1 according to the present embodiment is an MFP, and mainly includes a sheet conveyor 10, an image former 20, and a fixing device 30 (an example of a fixer). The image forming apparatus 1 may further include a finisher (finishing processor).

The sheet conveyor 10 includes a first tier paper feed roller 11, a timing roller 12, a paper discharge roller 13*a*, a reverse roller 13*b*, auto duplex unit (ADU) conveying rollers 14 and 15, a refeed roller 16, a paper discharge guide 17, a timing sensor 41, a paper discharge sensor 42, and ADU conveying sensors 43 and 44.

The first tier paper feed roller 11 feeds a recording medium from a paper feed cassette (not shown) to the conveying path TR1.

The timing roller 12 starts or stops at a timing synchronized with an image, thereby conveying the recording medium along the conveying path TR1.

The paper discharge roller 13*a* is provided at the most downstream position of the conveying path TR1 and discharges the recording medium out of the main body of the image forming apparatus 1.

The reverse roller 13*b* is provided on a reverse path TR2 positioned above the conveying path TR1 and reverses the recording medium on which duplex printing is performed in a switchback manner to convey it to a conveying path TR3.

The ADU conveying rollers 14 and 15 transport the recording medium on which duplex printing is performed along the conveying path TR3.

The refeed roller 16 is provided at a refeeding position on the most downstream side of the conveying path TR3 and feeds the recording medium from the refeeding position to the conveying path TR1.

The paper discharge guide (switching guide) 17 switches the conveying path for conveying the recording medium between the conveying path TR1 and the reverse path TR2 to guide the recording medium having passed through the fixing device 30 to the paper discharge roller 13*a* or the reverse roller 13*b*.

The timing sensor 41 detects the recording medium at a position upstream of the timing roller 12 on the conveying path TR1. The image forming apparatus 1 detects the length of the recording medium along the conveying direction by counting the time between on and off of the timing sensor 41.

The paper discharge sensor 42 detects the recording medium at a position upstream of the paper discharge roller 13*a* on the conveying path TR1.

The ADU conveying sensors 43 and 44 detect the recording medium on the conveying path TR3.

The image former 20 includes imaging units 21Y, 21M, 21C, and 21K, primary transfer rollers 22*a*, 22*b*, 22*c*, and 22*d*, an intermediate transfer belt 23, and a secondary transfer roller 24.

The imaging units 21Y, 21M, 21C, and 21K are disposed at predetermined intervals along the direction of extension of the intermediate transfer belt 23 on a lower portion of the intermediate transfer belt 23. The imaging units 21Y, 21M, 21C, and 21K respectively form toner images Y, M, C, and K on photoreceptors.

The primary transfer rollers 22*a*, 22*b*, 22*c*, and 22*d* and the photoreceptors of the imaging units 21Y, 21M, 21C, and 21K are respectively located on opposing sides of the intermediate transfer belt 23. The primary transfer rollers 22*a*, 22*b*, 22*c*, and 22*d* transfer the respective toner images of the imaging units 21Y, 21M, 21C, and 21K onto the intermediate transfer belt 23. The toner images Y, M, C, K are superimposed in order on the intermediate transfer belt 23 to form a color image.

The intermediate transfer belt 23 is an endless belt that is suspended over a plurality of rollers 25 without slack. The rollers 25 rotate counterclockwise in FIG. 1 to rotate the intermediate transfer belt 23 and convey the toner images formed on the intermediate transfer belt 23 to the position of the secondary transfer roller 24.

The secondary transfer roller 24 is provided at a position between the timing roller 12 and the fixing device 30 on the conveying path TR1. The secondary transfer roller 24 transfers the toner images formed on the intermediate transfer belt 23 to the recording medium.

The fixing device 30 includes a heating roller 31 and a pressure roller 32. The fixing device 30 rotates the heating roller 31 and the pressure roller 32 and causes the recording medium bearing the toner images to pass through a nip portion between the heating roller 31 and the pressure roller 32 to fix the toner images onto the recording medium.

Figure 2:
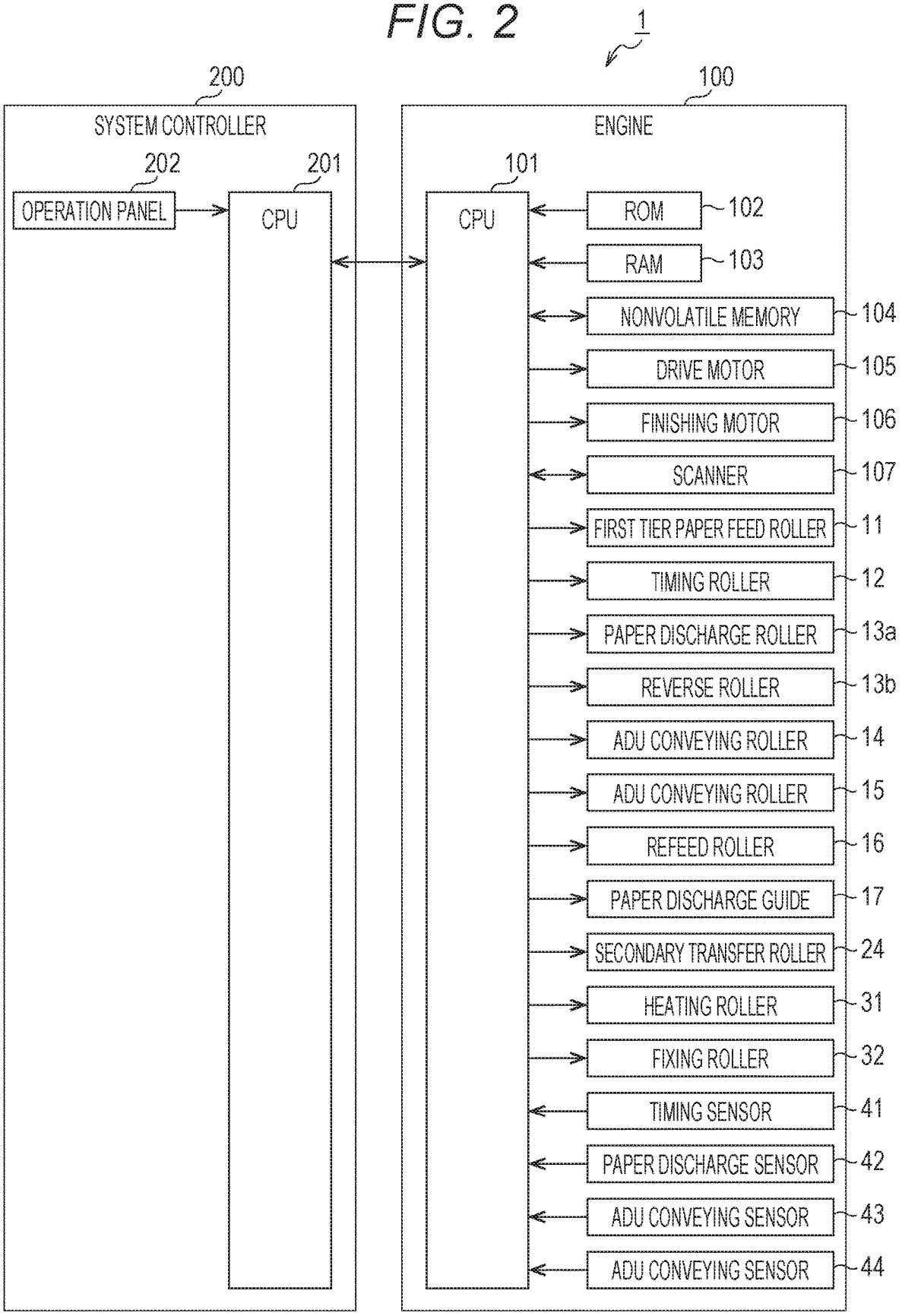
FIG. 2 is a block diagram showing a control configuration of the image forming apparatus according to the first embodiment of the present invention.

FIG. 2 is a block diagram showing a control configuration of the image forming apparatus 1 according to the first embodiment of the present invention.

Referring to FIG. 2, the image forming apparatus 1 includes an engine 100 and a system controller 200.

The engine 100 forms an image. The engine 100 includes a central processing unit (CPU) 101, a read only memory (ROM) 102, a random access memory (RAM) 103, a nonvolatile memory 104, a drive motor 105, a finishing motor 106, and a scanner 107.

The CPU 101 uniformly controls operations related to image formation while estimating timings, based on a control program stored in the ROM 102. The CPU 101 facilitates operations such as execution of a print job.

The ROM 102 stores, for example, a control program related to image formation and paper feed and conveyance in printing operations performed by the engine 100.

The RAM 103 is a volatile memory and is a work area when the CPU 101 executes the control program.

The nonvolatile memory 104 is a data storage area when the CPU 101 executes the control program.

The drive motor 105 drives, for example, various rollers.

The finishing motor 106 drives the finisher when the image forming apparatus 1 is equipped with a finisher.

The scanner 107 reads an image of a document.

The system controller 200 controls the entire image forming apparatus 1. The system controller 200 includes a CPU 201 and an operation panel 202. The CPU 201 instructs the CPU 101 in the engine 100 to execute printing and notifies the type of recording medium to be printed which is input via the operation panel 202.

The operation panel 202 receives various operations and displays various kinds of information. The operation panel 202 notifies the CPU 201 when the operation panel 202 has received input of the type of recording medium on which an image is to be formed.

Figure 3:
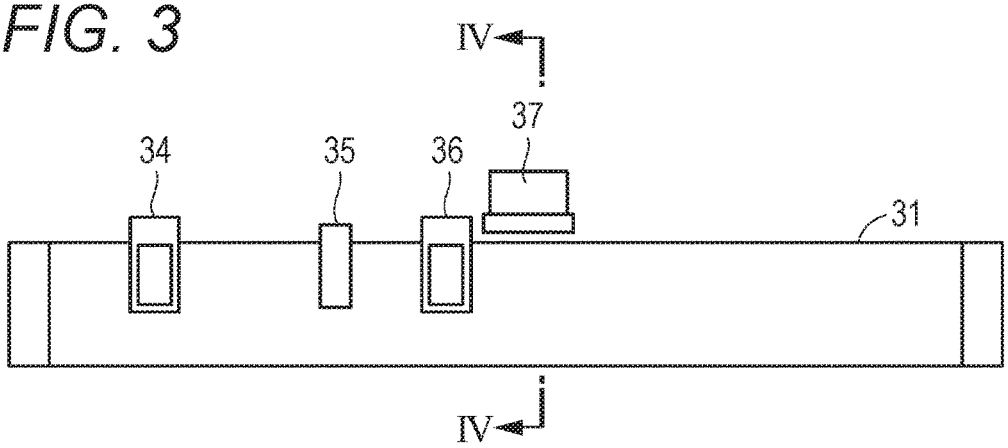
FIG. 3 is a cross-sectional view showing a configuration of a heating roller according to the first embodiment of the present invention.
Figure 4:
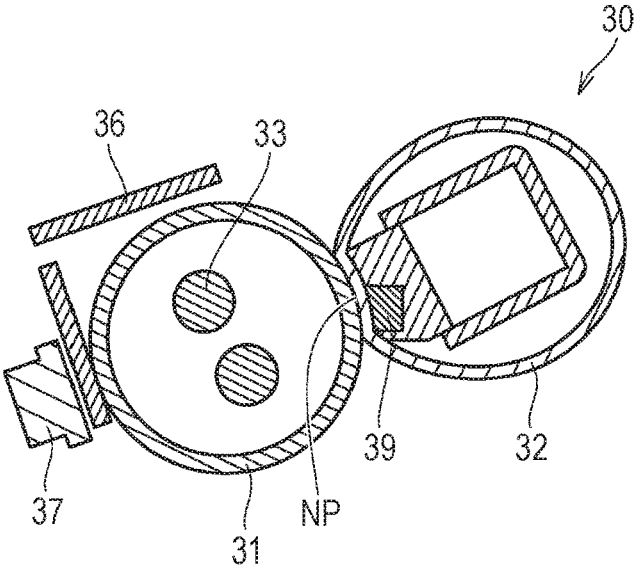
FIG. 4 is a cross-sectional view showing a configuration of a fixing device as viewed in a cross section taken along line IV-IV of FIG. 3.

FIG. 3 is a cross-sectional view showing a configuration of the heating roller 31 according to the first embodiment of the present invention. FIG. 4 is a cross-sectional view showing a configuration of the fixing device 30 as viewed in a cross section taken along line IV-IV of FIG. 3. Although in FIG. 4, a main thermistor 36 is shown for convenience of explanation, the main thermistor 36 is not actually visible.

Referring to FIG. 3, the fixing device 30 includes the heating roller 31, the pressure roller (fixing belt) 32, a halogen heater 33, a middle thermistor 34, a protective thermistor 35, the main thermistor 36, a heating thermostat 37, and a pad 39.

The heating roller 31 and the pressure roller 32 have a cylindrical shape and rotate about their respective axes of rotation.

The halogen heater 33 is provided inside the heating roller 31 and heats the heating roller 31.

The middle thermistor 34, the protective thermistor 35, and the main thermistor 36 each has a different detection position along the axis of rotation of the heating roller 31 on an outer periphery of the heating roller 31. The middle thermistor 34, the protective thermistor 35, and the main thermistor 36 measure the temperature of the heating roller 31 at their respective detection positions (which information is regarded as the temperature of the fixing device 30).

The heating thermostat 37 is provided on the outer periphery of the heating roller 31. The heating thermostat 37 interrupts the current flowing through the halogen heater 33 when the temperature of the heating roller 31 exceeds a predetermined temperature and prevents abnormal temperature rise of the heating roller 31.

The pad 39 is provided inside the pressure roller 32. The pad 39 presses the pressure roller 32 against the heating roller 31. The heating roller 31 and the pressure roller 32 thus form a nip portion NP.

Figure 5:
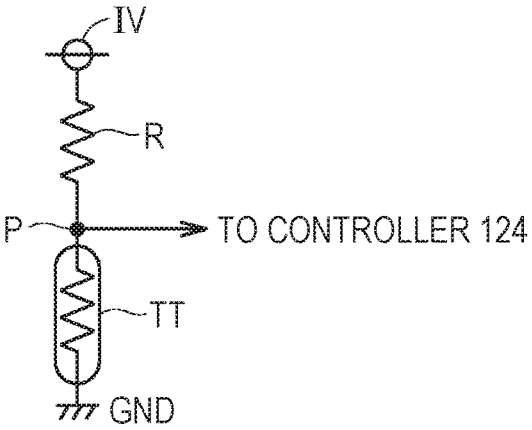
FIG. 5 is a diagram schematically showing an electric circuit of a portion of the fixing device that detects a temperature by a thermistor TT according to the first embodiment of the present invention.

FIG. 5 is a diagram schematically showing an electric circuit of a portion of the fixing device 30 that detects a temperature by a thermistor TT according to the first embodiment of the present invention.

Referring to FIG. 5, the thermistor TT corresponds to the middle thermistor 34, the protective thermistor 35, and the main thermistor 36. The thermistor TT and an electric resistance (voltage dividing resistor) R are connected in series between a voltage source (input voltage) IV and a ground potential GND of the image forming apparatus 1. One end of the halogen heater 33 is connected between the thermistor TT and the electric resistance R. Resistance of the thermistor TT changes with the temperature at the detection position. As a result, the potential of a terminal P between the electric resistance R and the thermistor TT changes. A controller 124 described later detects the temperature at the detection position of the thermistor TT based on the potential of the terminal P.

Figure 6:
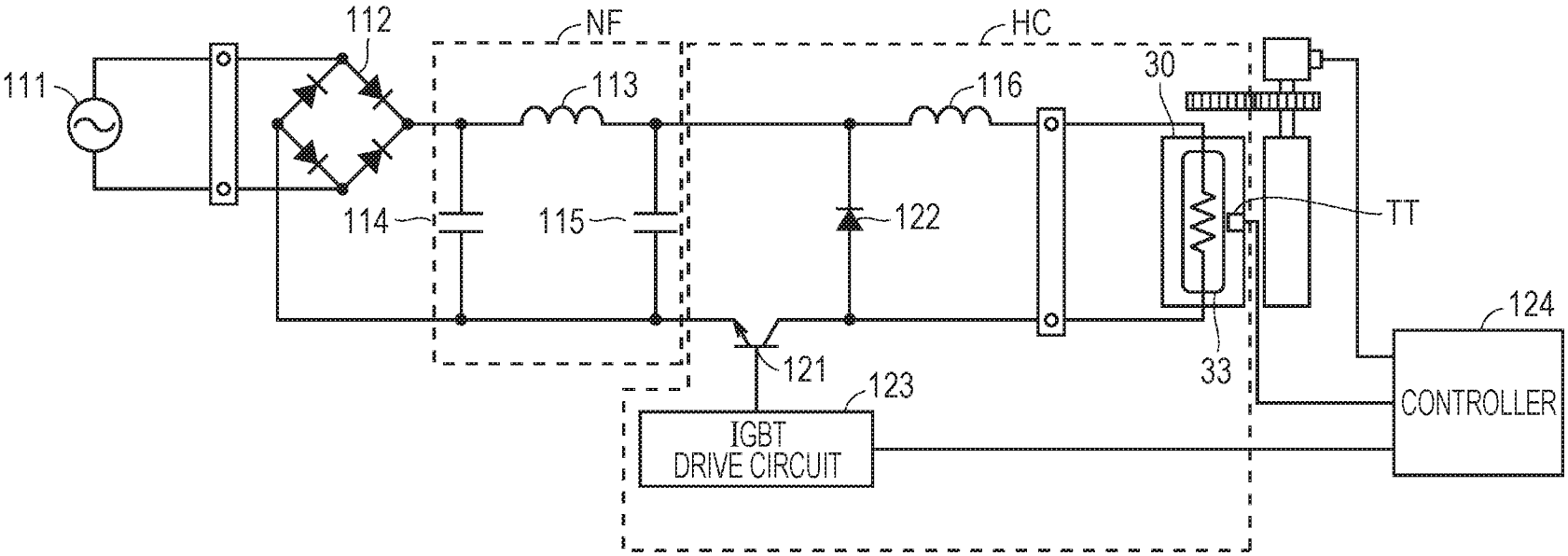
FIG. 6 is a diagram schematically showing a portion of an electric circuit (PWM control circuit) that controls a halogen heater according to the first embodiment of the present invention.

FIG. 6 is a diagram schematically showing a portion of an electric circuit (PWM control circuit) that controls the halogen heater 33 according to the first embodiment of the present invention.

Referring to FIG. 6, capacitors 114 and 115 and a coil 113 constitute a noise filter NF. An AC power supply 111 and a rectifier 112 are connected to an input side of the noise filter NF. An output side of the rectifier 112 is connected to a high-frequency chopper circuit HC via the noise filter NF.

In the high-frequency chopper circuit HC, a coil 116 and the halogen heater 33 are connected in series. A regenerative diode 122 causes magnetic energy accumulated in the coil 116 to flow to the halogen heater 33 as a regenerative current when an insulated gate bipolar transistor (IGBT) 121, which is a switching element, is controlled to be in an off state. A cathode side of the regenerative diode 122 is connected between the coil 113 and the coil 116, and an anode side thereof is connected between the halogen heater 33 and the IGBT 121.

An output terminal of an IGBT drive circuit 123 is connected to a gate terminal to which a drive signal of the IGBT 121 is input. The controller 124 (an example of a control unit) is connected to the IGBT drive circuit 123. The controller 124 includes, for example, the CPU 101, the ROM 102, and the RAM 103 of FIG. 2. The controller 124 inputs a PWM control signal to the IGBT drive circuit 123. A collector terminal of the IGBT 121 is connected to the halogen heater 33. An emitter terminal of the IGBT 121 is connected to an output side of the rectifier 112. The thermistor TT detects the temperature of the fixing device 30 and outputs the detected temperature information to the controller 124.

Figure 7:
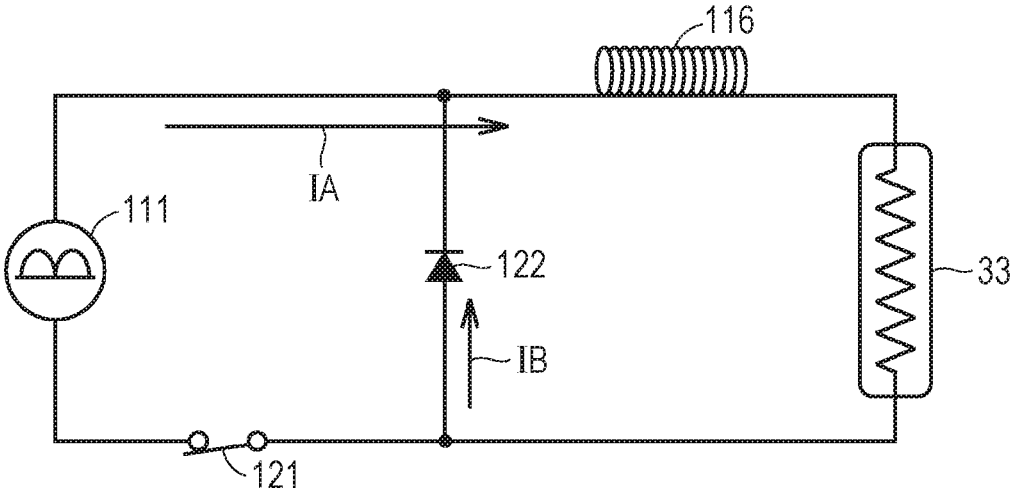
FIG. 7 is a diagram schematically showing current flows in the PWM control circuit of FIG. 6.
Figure 8:
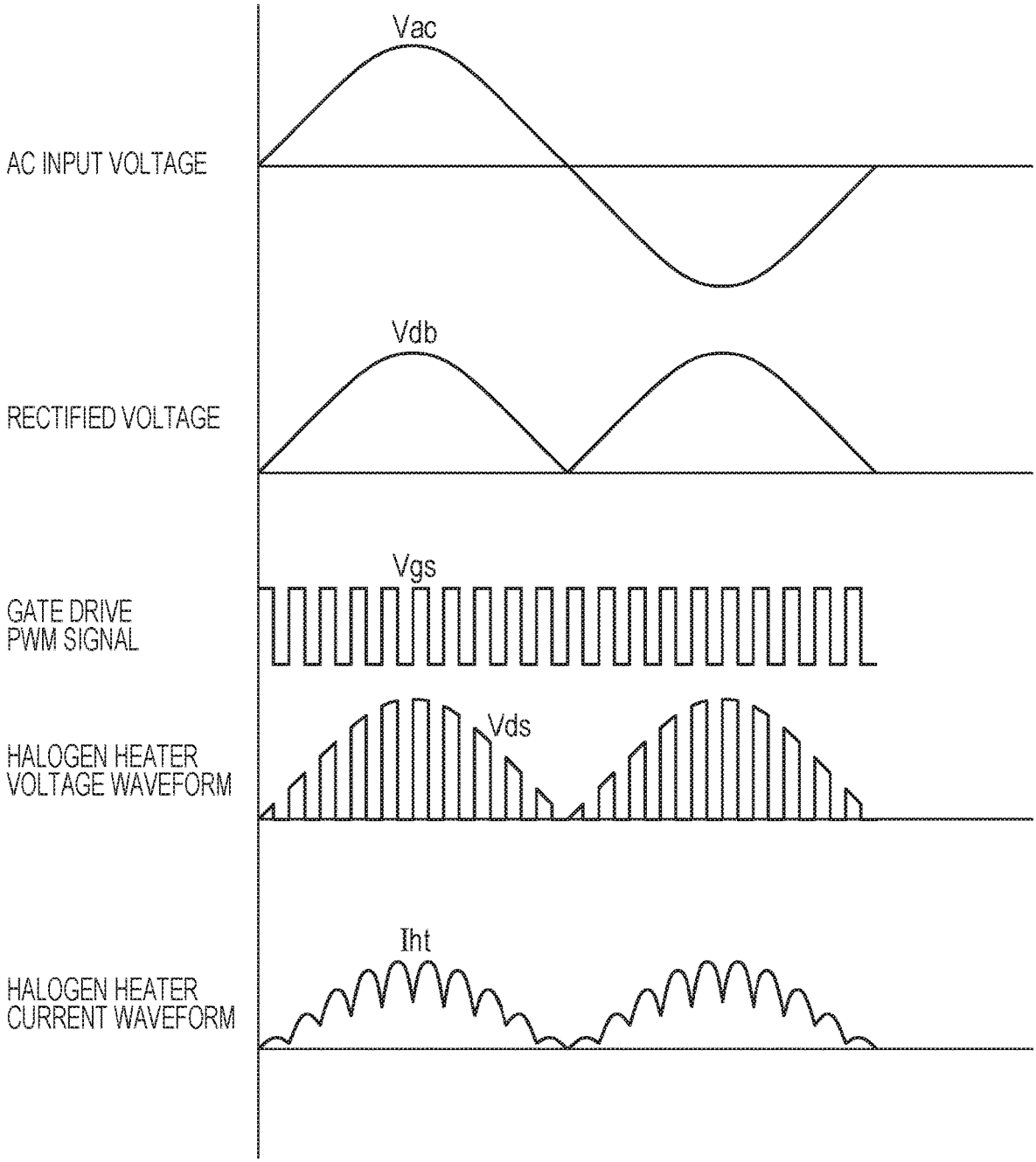
FIG. 8 is a diagram schematically showing temporal changes in a current value or a voltage value at respective locations in the PWM control circuit of FIG. 6.

FIG. 7 is a diagram schematically showing current flows in the PWM control circuit of FIG. 6. FIG. 8 is a diagram schematically showing temporal changes in a current value or a voltage value at respective locations in the PWM control circuit in FIG. 6. It should be noted that in FIG. 7, the members of the PWM control circuit are shown in a simplified manner.

The operation of the PWM control circuit will now be described with reference to FIGS. 6 to 8. An input voltage Vac, which is an output of the AC power supply 111, is supplied to the rectifier 112 and is full-wave rectified to be a rectified voltage Vdb. The rectified voltage Vdb is input to the noise filter NF to remove noise. The capacitors 114 and 115 of the noise filter NF prevent high frequency noise of a pulse current flowing through the IGBT 121 from leaking to the AC power supply 111 side.

The controller 124 controls power supplied to the halogen heater 33 by PWM control, which changes the duty ratio of a pulse wave to perform modulation, through the IGBT drive circuit 123. A duty cycle is the ratio of time to supply power to time of one cycle.

More specifically, when supplying power to the halogen heater 33, the controller 124 inputs a PMW signal for turning on the halogen heater 33 to the IGBT drive circuit 123. The IGBT drive circuit 123 generates a drive signal Vgs which is a pulse train for turning the IGBT 121 on and off based on the frequency and the duty cycle of the PWM signal input from the controller 124 and applies the drive signal Vgs to the gate terminal of the IGBT 121. The IGBT 121 is driven at an operating frequency (for example, 20 kHz) much higher than the frequency of the AC power supply 111.

As a result, a voltage Vds is applied to the halogen heater 33, and a current Iht flows therethrough. When the IGBT 121 is turned on, a current (current IA in FIG. 7) full-wave rectified by the rectifier 112 flows through the coil 116 and the halogen heater 33 via the IGBT 121. The coil 116 stores part of the flowing current IA as magnetic energy. When the IGBT 121 is turned off the magnetic energy stored in the coil 116 is released and a current (current IB in FIG. 7) flows through the halogen heater 33. The current IB flows through the regenerative diode 122 and returns to the coil 116 again.

The operation described above causes the current Iht supplied to the halogen heater 33 to have a current waveform close to a sinusoidal wave as shown in FIG. 8, thereby improving power factor and reducing high frequency currents. The current Iht of the halogen heater 33 can be controlled by increasing or decreasing the duty cycle of the PWM control. Thus, power consumption of the halogen heater 33 can also be accurately controlled by the duty cycle of the PWM control, and temperature ripple of the fixing device 30 can also be reduced. Reduced temperature ripple of the fixing device 30 provides advantages such as stabilization of color development, for example, in color printing.

In an image forming apparatus, a configuration using a halogen heater is provided in a fixing device for fixing toner on a recording medium (sheet of paper). The fixing device melts the toner on the recording medium by heat and pressure and fixes the toner. A heat source is thus generally mounted on the fixing device, and here, a halogen heater is provided as the heat source.

Figure 9:
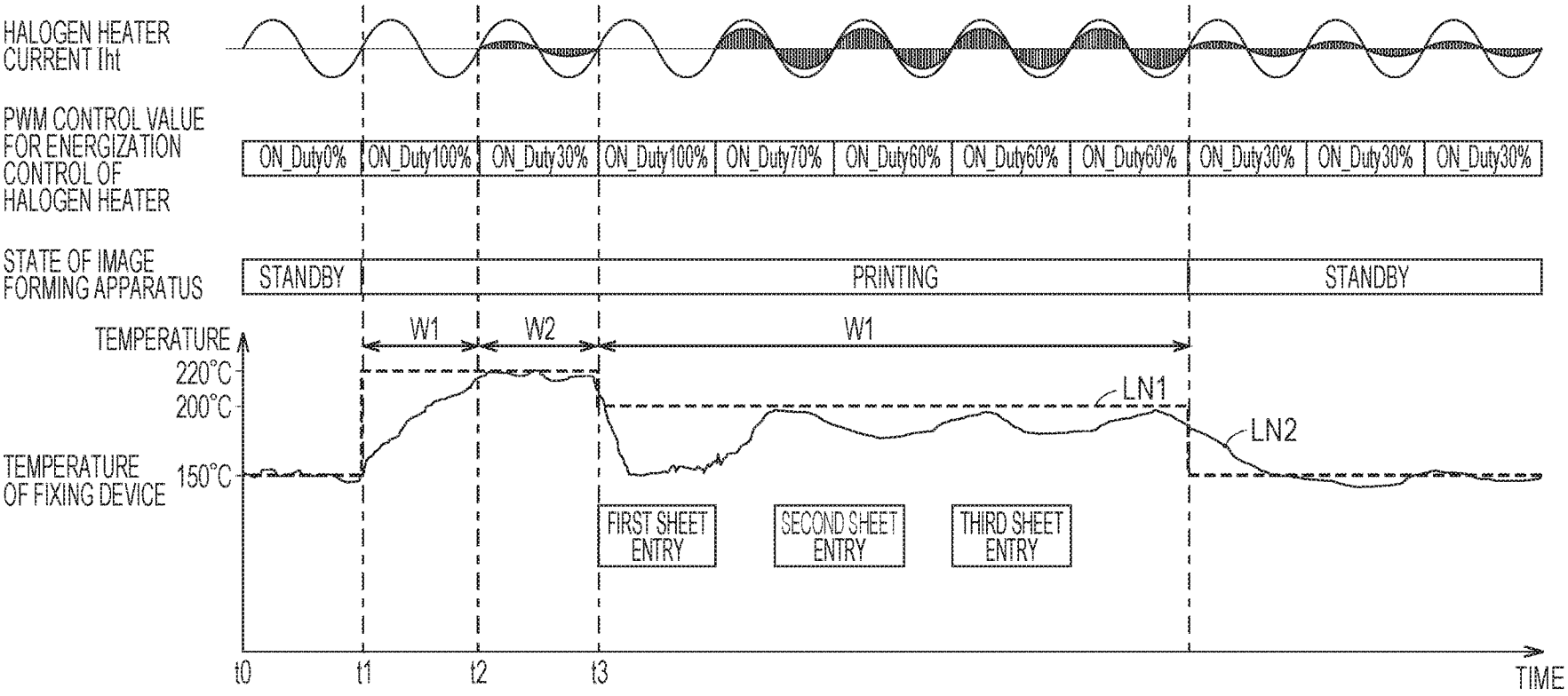
FIG. 9 is a diagram illustrating an operation related to setting of a lower limit of a duty cycle of PWM control by a controller according to the first embodiment of the present invention.

FIG. 9 is a diagram illustrating an operation related to setting of a lower limit of the duty cycle of the PWM control by the controller 124 according to the first embodiment of the present invention. Line LN1 in FIG. 9 is a target controlled temperature of the fixing device 30, and line LN2 is the actual temperature of the fixing device 30. Section W1 indicates a time period during which the power supplied to the halogen heater 33 is controlled in a first control state in which the lower limit of the duty cycle is set to 30%. Section W2 indicates a time period during which the power supplied to the halogen heater 33 is controlled in a second control state in which the lower limit of the duty cycle is set to 10%.

Referring to FIG. 9, the controller 124 switches a control state for controlling the power supplied to the halogen heater 33 between the first control state in which the lower limit of the duty cycle is set to 30% and the second control state in which the lower limit of the duty cycle is set to 10%, according to the state of the fixing device 30 (timing at which a sheet of paper enters the fixing device 30 in the present embodiment).

From time t0 to time t1, the image forming apparatus 1 is in a standby state. The controller 124 sets the target controlled temperature of the fixing device 30 to 150° C.

When a print job is input to the image forming apparatus 1 at time t1, the controller 124 sets the target controlled temperature of the fixing device 30 to 220° C. and controls the power supplied to the halogen heater 33 in the first control state in which the lower limit of the duty cycle is set to 30%. Also, at time t1, since there is a large difference between the target controlled temperature and the actual temperature of the fixing device 30, the controller 124 sets the duty cycle of the PWM control high (for example, 100%) with the lower limit being 30% in order to rapidly raise the temperature of the fixing device 30 to the target controlled temperature.

When a first sheet enters, the heat of the fixing device 30 is absorbed by the sheet, and the temperature of the fixing device 30 abruptly drops. For this reason, from the time the print job is input until the first sheet enters the fixing device 30 (time t1 to t3), the target controlled temperature (220° C.) of the fixing device 30 is set higher than the target controlled temperature (200° C.) after the first sheet enters the fixing device 30.

The temperature of the fixing device 30 reaches the target controlled temperature (220° C.) at time t2 just before (a predetermined time before) the first sheet enters the fixing device 30. The controller 124 switches to the control state in which the lower limit of the duty cycle is set to 10% while maintaining the target controlled temperature of the fixing device 30 at 220° C. In order to maintain the temperature of the fixing device 30 at around the target controlled temperature, the controller 124 sets the duty cycle of the PWM control low (for example, 30%) with the lower limit being 10%.

Since the target controlled temperature of the fixing device 30 is set to a high value of 220° C. during a predetermined time (time t2 to t3) just before the first sheet enters the fixing device 30, the difference is reduced between the target controlled temperature of the fixing device 30 and a temperature (for example, 245° C.) at which a high-temperature abnormality is detected. In such a situation, setting the lower limit of the duty cycle to as low as 10% (switching to the second control state) enables ripple in the temperature of the fixing device 30 to be suppressed and allows fine adjustment of the temperature of the fixing device 30. As a result, it is possible to maintain the temperature of the fixing device 30 close to the target controlled temperature while avoiding false detections of high-temperature abnormalities.

At time t3 when the first sheet enters the fixing device 30, the heat of the fixing device 30 is absorbed by the sheet, so that the temperature of the fixing device 30 drops significantly. The controller 124 sets the target controlled temperature of the fixing device 30 to 200° C. and switches the control state to the first control state in which the lower limit of the duty cycle is set to 30%. In order to quickly raise the temperature of the fixing device 30 to the target controlled temperature, the controller 124 sets the duty cycle of the PWM control high (for example, 100%) with the lower limit being 30%.

Since heat is accumulated in the fixing device 30 after the first sheet enters (after time t3), there is less temperature drop in the fixing device 30 when a second and subsequent sheets enter the fixing device 30. The target controlled temperature of the fixing device 30 can thus be lowered to 200° C. after the first sheet enters the fixing device 30 so that the difference is increased between the target controlled temperature of the fixing device 30 and the temperature at which the high-temperature abnormality of the fixing device 30 is detected. In such a situation, setting the lower limit of the duty cycle to as low as 30% enables wear of the halogen heater 33 to be suppressed as will be described later.

It should be noted that the method of controlling the power supplied to the halogen heater 33 by the controller 124 may be a method other than the PWM control. When a lower limit of an amount of power per cycle of the power supplied to the halogen heater 33 in the first control state is set to a first value and a lower limit of an amount of power per cycle of the power supplied to the halogen heater 33 in the second control state is set to a second value, it is only required that the second value is lower than the first value.

Figure 10:
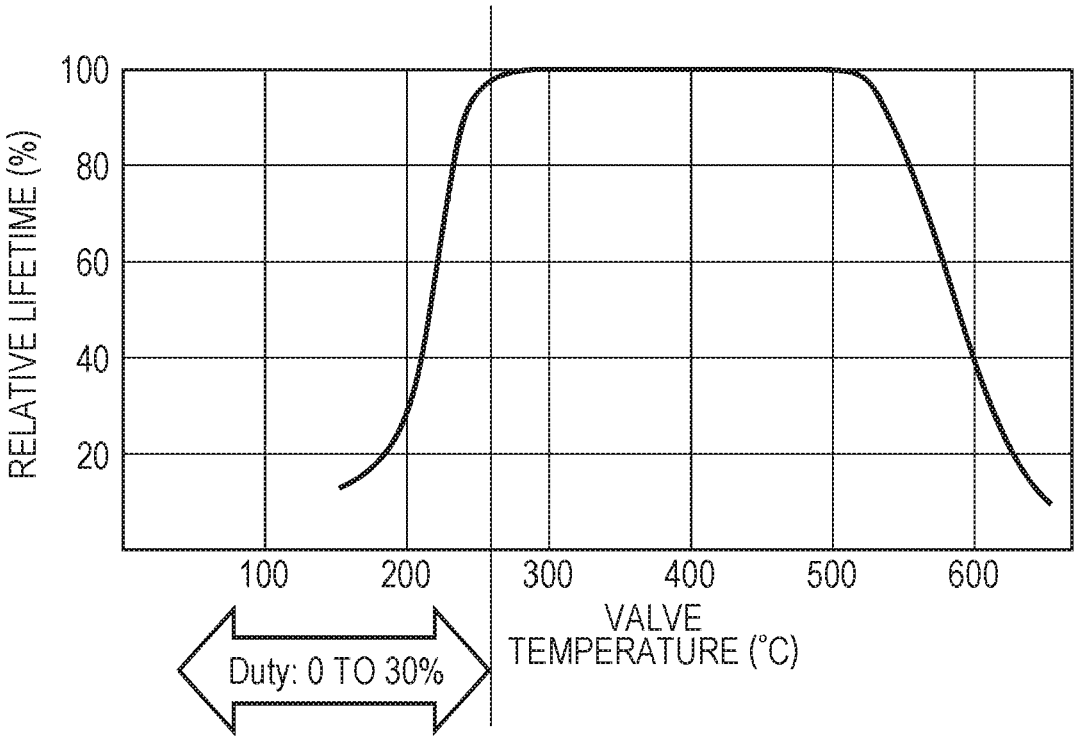
FIG. 10 is a diagram schematically showing the relationship between valve temperature of the halogen heater and relative life of the halogen heater.

FIG. 10 is a diagram schematically showing the relationship between valve temperature of the halogen heater 33 and relative life of the halogen heater 33.

Referring to FIG. 10, the valve temperature of the halogen heater 33 changes according to the duty cycle of the PWM control (the amount of power supplied to the halogen heater 33). When the halogen heater 33 is used at a low temperature, the halogen heater 33 wears rapidly and the life of the halogen heater 33 abruptly decreases. Here, the life of the halogen heater 33 abruptly decreases under a condition in which the valve temperature of the halogen heater 33 is less than 250° C. (which corresponds to a condition in which the duty cycle of the PWM control is less than 30%).

In the halogen heater 33, a cycle is carried out in which tungsten evaporates from a tungsten filament, halogen compounds are produced then decomposed by heat, and tungsten is regenerated as the tungsten filament. Using the halogen heater 33 at a low temperature makes it difficult for the halogen compounds to be decomposed by the heat and the tungsten filament to be regenerated. This causes the cycle to be inhibited and accelerates wear of the halogen heater 33.

It is thus preferable to set the lower limits of the amount of power per cycle of the power supplied to the halogen heater 33 in the first control state and the second control state such that the life of the halogen heater 33 when the amount of power is set to the lower limit in the second control state (10% duty cycle in this case) is 80% or less of the life of the halogen heater 33 when the amount of power is set to the lower limit in the first control state (30% duty cycle in this case).

Figure 11:
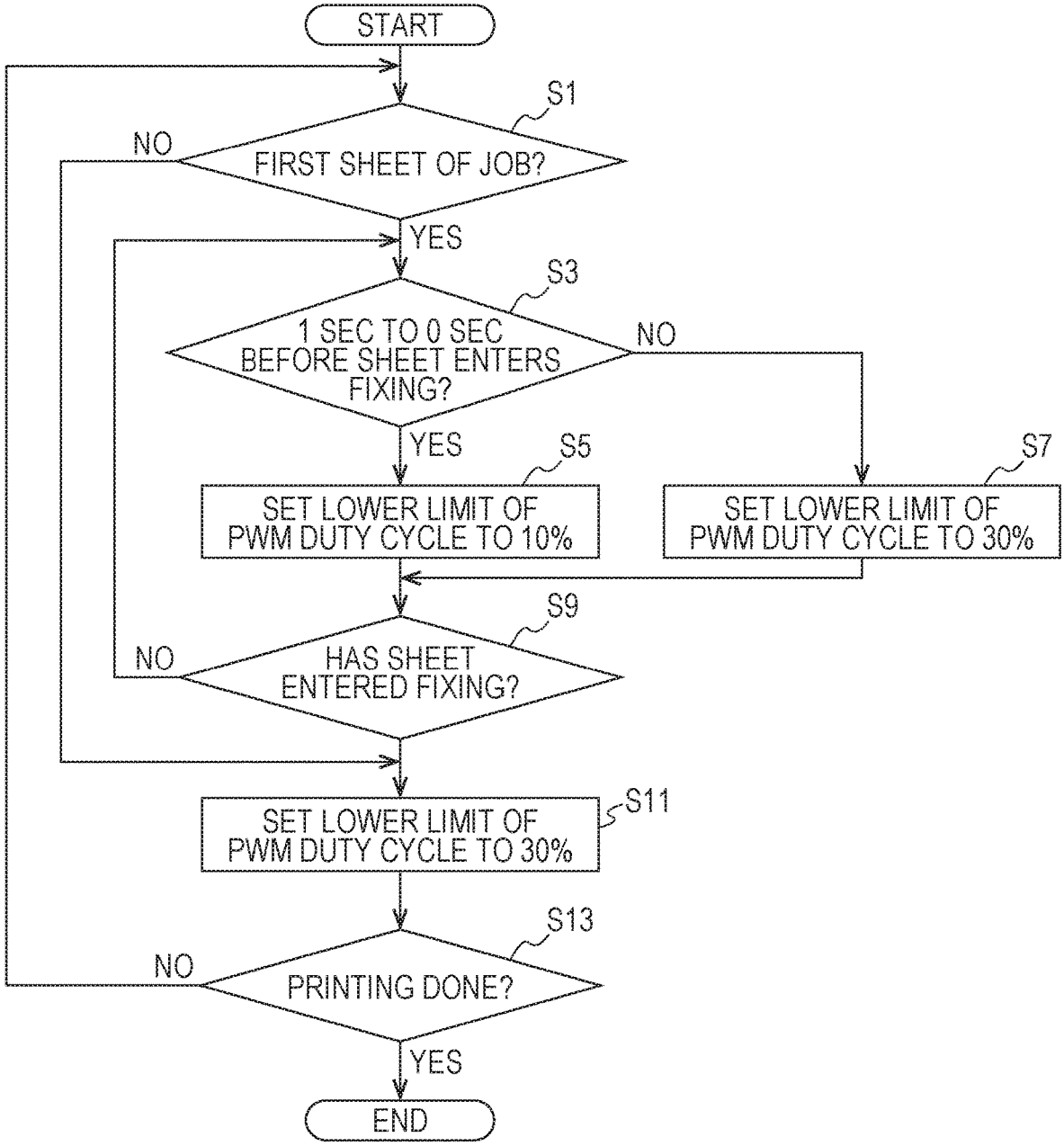
FIG. 11 is a flowchart showing the operation related to the setting of the lower limit of the duty cycle of the PWM control by the controller according to the first embodiment of the present invention.

FIG. 11 is a flowchart showing the operation related to the setting of the lower limit of the duty cycle of the PWM control by the controller 124 according to the first embodiment of the present invention. It should be noted that the steps in subsequent flowcharts are implemented by the CPU 101 executing the control program stored in the ROM 102.

Referring to FIG. 11, when a sheet on which a print job is to be executed starts to be fed, the controller 124 determines whether the fed sheet is a first sheet of the print job (S1).

If it is determined in step S1 that the fed sheet is the first sheet of the print job (YES in S1), the controller 124 determines whether the current time is within a period from one second before the sheet enters the fixing device 30 to when the sheet enters the fixing device 30 (S3).

If it is determined in step S3 that the current time is within the period from one second before the sheet enters the fixing device 30 to when the sheet enters the fixing device 30 (YES in S3), the controller 124 sets the lower limit of the duty cycle of the PWM control to 10% (S5), and proceeds to step S9.

If it is determined in step S3 that the current time is not within the period from one second before the sheet enters the fixing device 30 to when the sheet enters the fixing device 30 (NO in S3), the controller 124 sets the lower limit of the duty cycle of the PWM control to 30% (S7), and proceeds to step S9.

In step S9, the controller 124 determines whether the sheet has entered the fixing device 30 (S9).

If it is determined in step S9 that the sheet has not entered the fixing device 30 (NO in S9), the controller 124 proceeds to step S3.

If it is determined in step S1 that the fed sheet is a second or subsequent sheet of the print job (NO in S1), or if it is determined in step S9 that the sheet has entered the fixing device 30 (YES in S9), the controller 124 sets the lower limit of the duty cycle of the PWM control to 30% (S11) and determines whether printing is finished (S13).

If it is determined in step S13 that the printing is not finished (NO in S13), the controller 124 proceeds to step S1.

If it is determined in step S13 that the printing is finished (YES in S13), the controller 124 ends the process.

According to the present embodiment, the control state for controlling the power supplied to the halogen heater 33 can be switched, according to the state of the fixing device 30, between the first control state in which the lower limit of the amount of power per cycle of the power supplied to the halogen heater 33 is set to the first value and the second control state in which the lower limit of the amount of power per cycle of the power supplied to the halogen heater 33 is set to the second value. Thus, decrease in the life of the halogen heater 33 can be inhibited by controlling the power supplied to the halogen heater 33 in the first control state, and ripple in the temperature of the fixing device 30 can be suppressed by controlling the same in the second control state when necessary.

According to the present embodiment, the power supplied to the halogen heater 33 is controlled in the second control state in the period from one second before the first sheet of the print job enters the fixing device 30 to when the first sheet enters the fixing device 30 and is otherwise controlled in the first control state. Thus, it is possible to effectively inhibit the decrease in the life of the halogen heater 33 and to effectively suppress the ripple in the temperature of the fixing device 30.

Second Embodiment

In the present embodiment, when the target controlled temperature of the fixing device 30 is equal to or higher than a predetermined temperature, the controller 124 controls the power supplied to the halogen heater 33 in the second control state in which the lower limit of the duty cycle of the PWM control is 10%.

Figure 12:
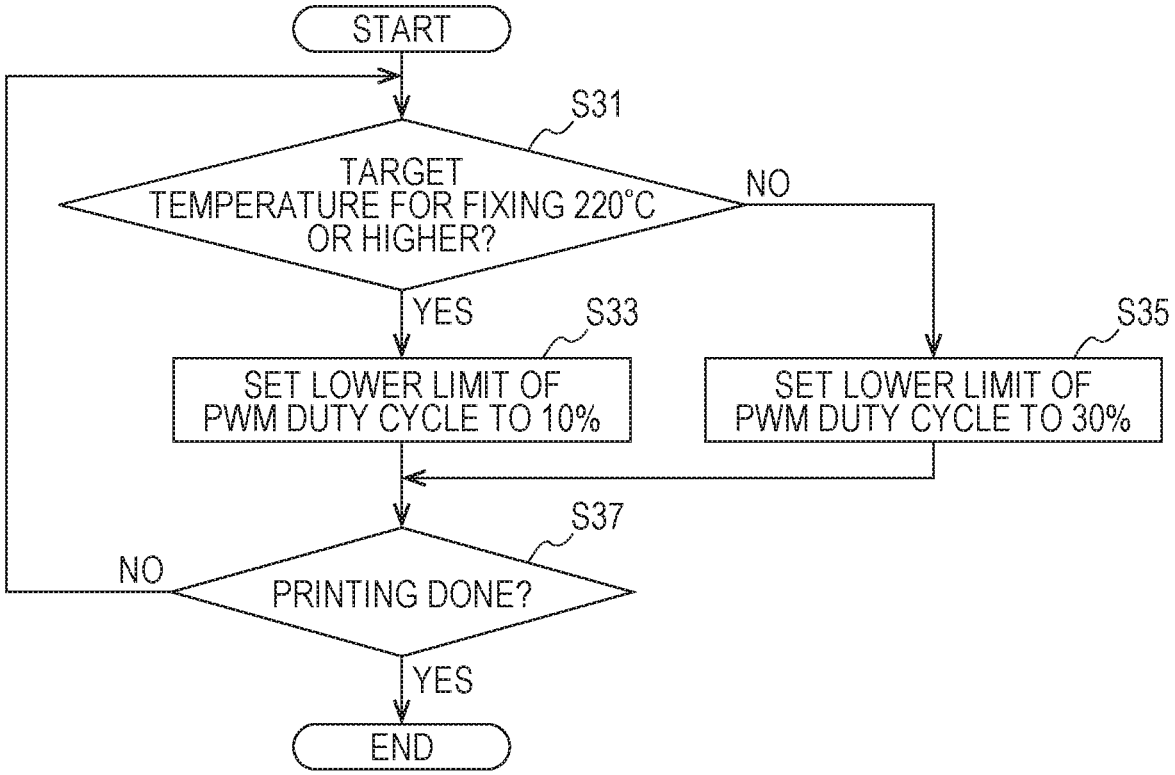
FIG. 12 is a flowchart showing the operation related to the setting of the lower limit of the duty cycle of the PWM control by the controller according to a second embodiment of the present invention.

FIG. 12 is a flowchart showing the operation related to the setting of the lower limit of the duty cycle of the PWM control by the controller 124 according to a second embodiment of the present invention.

Referring to FIG. 12, when a sheet on which a print job is to be executed starts to be fed, the controller 124 determines whether the target controlled temperature of the fixing device 30 is 220° C. or higher (S31).

In step S31, if it is determined that the target controlled temperature of the fixing device 30 is 220° C. or higher (YES in S31), the controller 124 sets the lower limit of the duty cycle of the PWM control to 10% (S33) and proceeds to step S37.

If it is determined in step S31 that the target controlled temperature of the fixing device 30 is less than 220° C. (NO in S31), the controller 124 sets the lower limit of the duty cycle of the PWM control to 30% (S35) and proceeds to step S37.

In step S37, the controller 124 determines whether the printing is finished (S37).

If it is determined in step S37 that the printing is not finished (NO in S37), the controller 124 proceeds to step S31.

If it is determined in step S37 that the printing is finished (YES in S37), the controller 124 ends the process.

The configurations and operations of the image forming apparatus 1 other than those described above are the same as those in the first embodiment, and thus description thereof will not be repeated.

According to the present embodiment, the ripple is suppressed by controlling the power supplied to the halogen heater 33 in the second control state when the difference is small between the target controlled temperature of the fixing device 30 and the temperature at which the high-temperature abnormality of the fixing device 30 is detected, and the decrease in the life of the halogen heater 33 is effectively inhibited by otherwise controlling the same in the first control state.

Third Embodiment

Figure 13:
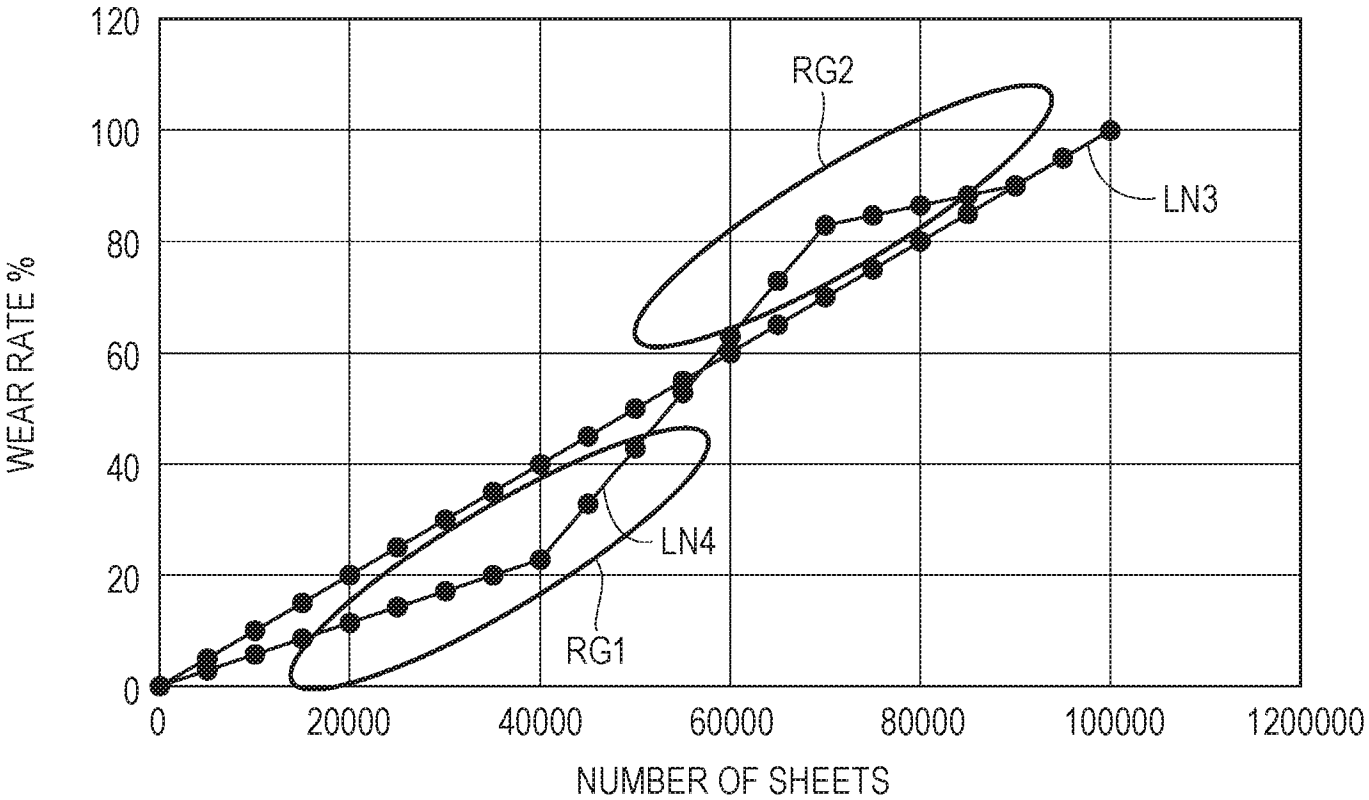
FIG. 13 is a diagram schematically showing changes in wear rate of the halogen heater relative to the number of printed sheets.

FIG. 13 is a diagram schematically showing changes in wear rate of the halogen heater 33 relative to the number of printed sheets. Line LN3 in FIG. 13 shows a change in the wear rate of the halogen heater 33 predicted from the number of sheets printed by the image forming apparatus 1, and line LN4 in FIG. 13 shows a change in the wear rate of the halogen heater 33.

Referring to FIG. 13, the extent of wear of the halogen heater 33 relative to the extent of wear for which it is determined that the halogen heater 33 needs to be replaced is referred to as the wear rate of the halogen heater 33. A state in which the wear rate of the halogen heater 33 increases at a constant rate relative to the number of sheets printed by the image forming apparatus 1 is a reference state. When usage under severe conditions (for example, a condition in which the duty cycle of the PWM control is less than 30%) is low, the rate of increase in the wear rate of the halogen heater 33 is less than the reference as indicated by region RG1. When usage under severe conditions is high, the rate of increase in the wear rate of the halogen heater 33 is greater than the reference as indicated by region RG2.

Thus, in the present embodiment, the controller 124 switches the control state for controlling the power supplied to the halogen heater 33 between the first control state in which the lower limit of the duty cycle of the PWM control is set to 30% and the second control state in which the lower limit of the duty cycle of the PWM control is set to 10%, according to the extent of wear of the halogen heater 33.

As shown in formula (1) below, the controller 124 calculates the wear rate (extent of wear) of the halogen heater 33 based on a time during which the power supplied to the halogen heater 33 is controlled in the first control state and a time during which the power supplied to the halogen heater 33 is controlled in the second control state.

$$\text{Wear rate (\%) of halogen heater}=[\{(\text{time}(h)\text{ of use with 10\% duty cycle of PWM control})\times 1.8\}+\{(\text{time}(h)\text{ of use with 20\% duty cycle of PWM control})\times 1.4\}+\{(\text{time}(h)\text{ of use with 30\% duty cycle of PWM control})\times 1.2\}+\{(\text{time}(h)\text{ of use with duty cycle of PWM control greater than 30\%})\times 1\}]\times 100/5000(h) \quad (1)$$

As described with reference to FIG. 10, the halogen heater 33 wears rapidly when used under conditions in which the duty cycle of the PWM control is low. Thus, the wear rate of the halogen heater 33 is calculated by weighting the duty cycles of the PWM control. Specifically, when the halogen heater 33 is used with the duty cycle of the PWM control set to 10%, the usage time multiplied by 1.8 is counted as the usage time. When the halogen heater 33 is used with the duty cycle of the PWM control set to 20%, the usage time multiplied by 1.4 is counted as the usage time. When the halogen heater 33 is used with the duty cycle of the PWM control set to 30%, the usage time multiplied by 1.2 is counted as the usage time. When the halogen heater 33 is used with the duty cycle of the PWM control set to a value greater than 30%, the usage time multiplied by 1 is counted as the usage time. The ratio of the total usage time counted in this way to a fixed value (5000 (h)) is the wear rate. The fixed value is the usage time when the extent of wear reaches a point at which it is determined that the halogen heater 33 needs to be replaced.

The controller 124 determines that the halogen heater 33 is not worn as much as predicted when the calculated wear rate of the halogen heater 33 is less than the wear rate (line LN3 in FIG. 13) of the halogen heater 33 predicted from the number of sheets printed by the image forming apparatus 1, and controls the power supplied to the halogen heater 33 in the second control state in which the lower limit of the duty cycle of the PWM control is set to 10%. On the other hand, the controller 124 determines that the halogen heater 33 is worn more than predicted when the calculated actual wear rate of the halogen heater 33 is greater than the wear rate of the halogen heater 33 predicted from the number of sheets printed by the image forming apparatus 1, and controls the power supplied to the halogen heater 33 in the first control state in which the lower limit of the duty cycle of the PWM control is set to 30%.

Figure 14A:
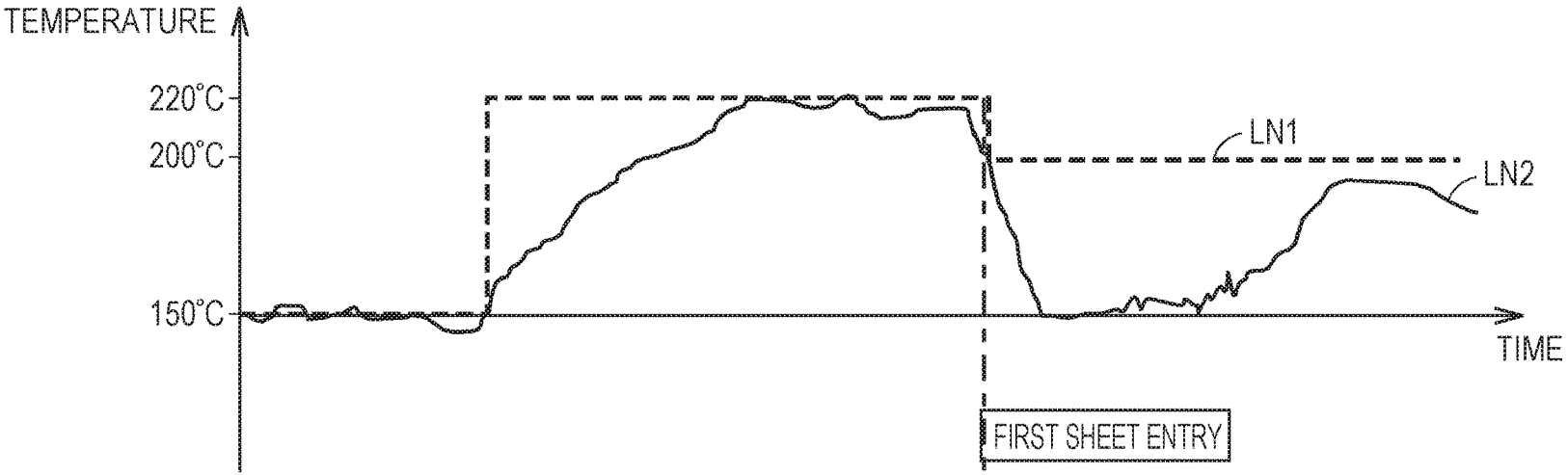
FIGS. 14A and 14B are diagrams schematically showing temporal changes in the temperature of the fixing device when the image forming apparatus executes a print job according to a third embodiment of the present invention.
Figure 14B:
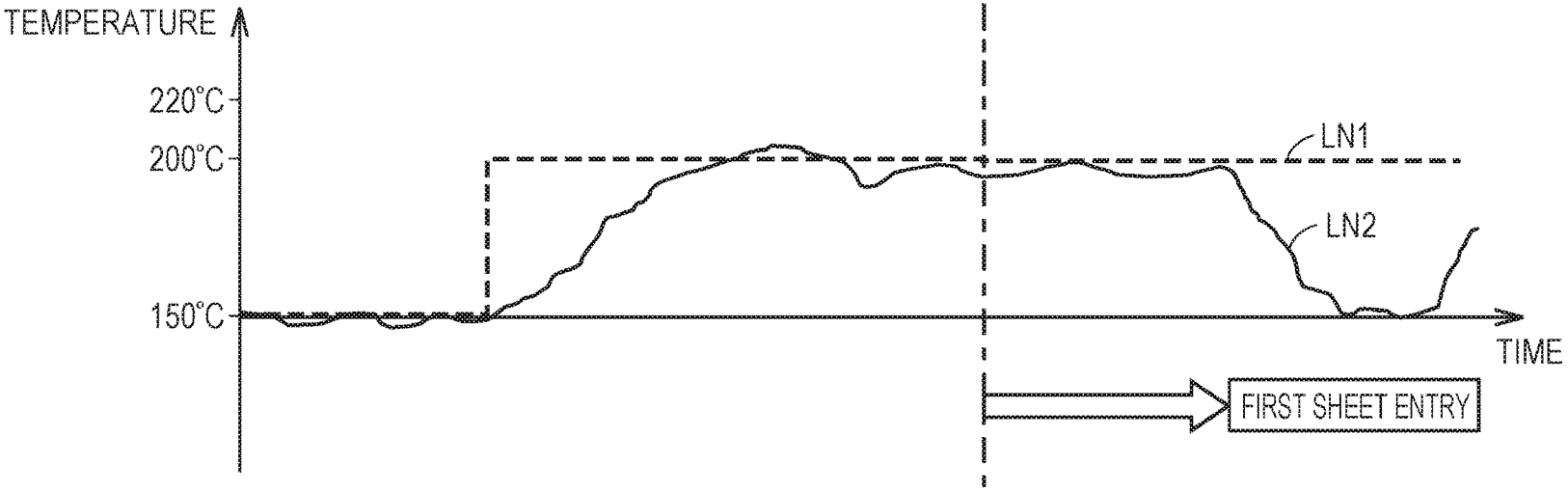

FIGS. 14A and 14B are diagrams schematically showing temporal changes in the temperature of the fixing device 30 when the image forming apparatus 1 executes a print job according to a third embodiment of the present invention. Note that lines LN1 in FIGS. 14A and 14B show the target controlled temperature of the fixing device 30, and lines LN2 thereof show the actual temperature of the fixing device 30.

Referring to FIGS. 14A and 14B, in the present embodiment, in the case (FIG. 14B) in which the power supplied to the halogen heater 33 is controlled in the second control state in which the lower limit of the duty cycle of the PWM control is set to 10%, the controller 124 may set the target controlled temperature to a lower temperature (always at 200° C. in this case) and may delay the timing (for example, for about four seconds) at which the first sheet enters the fixing device 30 compared with the case (FIG. 14A) in which the power supplied to the halogen heater 33 is controlled in the first control state in which the lower limit of the duty cycle of the PWM control is set to 30%.

As a result, the amount of heat accumulated in the fixing device 30 can be increased before the first sheet of the print job enters the fixing device 30, and the temperature drop of the fixing device 30 due to the passage of the first sheet can be suppressed. In addition, the difference can be increased between the target controlled temperature of the fixing device 30 and the temperature at which the high-temperature abnormality is detected so that false detection of the high-temperature abnormality due to ripple in the temperature of the fixing device 30 can be avoided.

Figure 15:
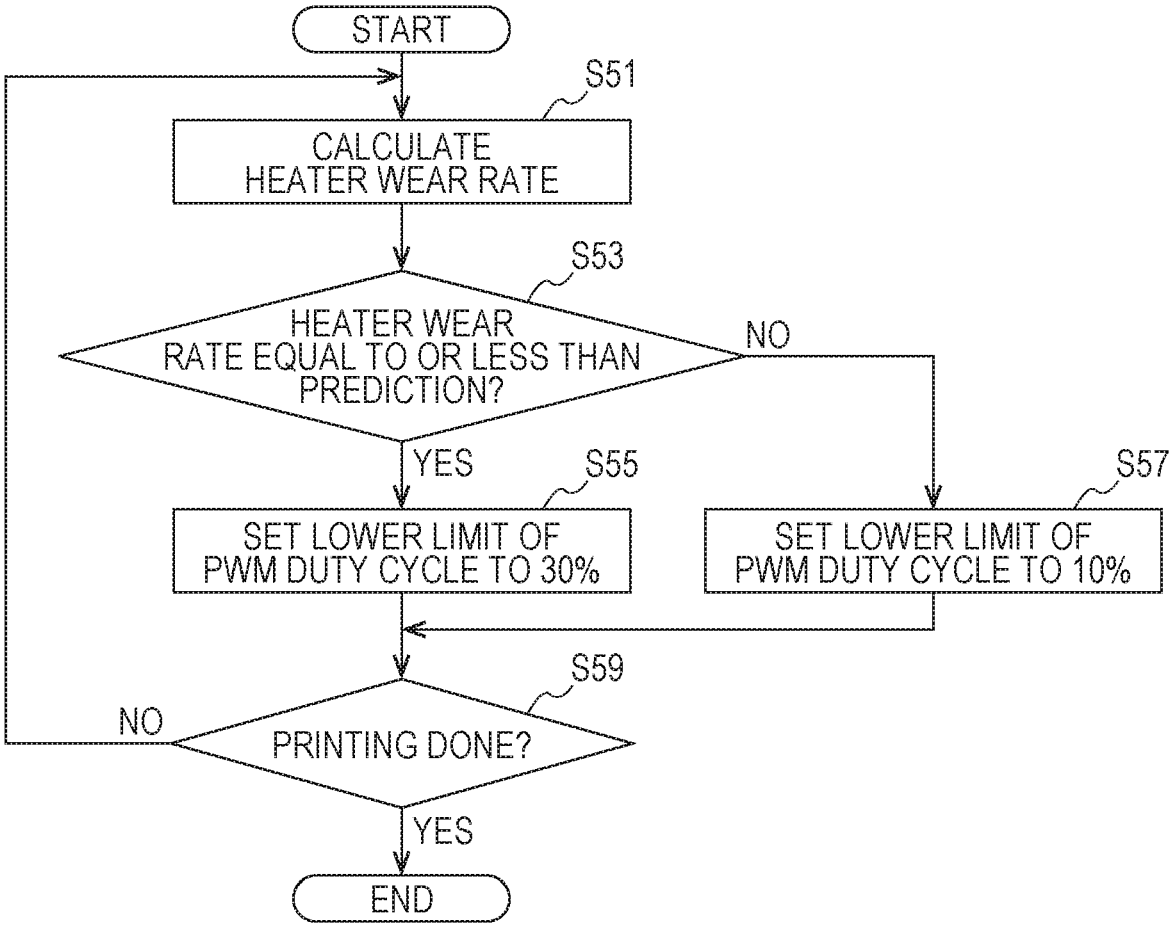
FIG. 15 is a flowchart showing the operation related to the setting of the lower limit of the duty cycle of the PWM control by the controller according to the third embodiment of the present invention.

FIG. 15 is a flowchart showing the operation related to the setting of the lower limit of the duty cycle of the PWM control by the controller 124 according to the third embodiment of the present invention.

Referring to FIG. 15, when a sheet on which a print job is to be executed starts to be fed, the controller 124 calculates the wear rate of the halogen heater 33 (S51) and determines whether the wear of the halogen heater 33 is equal to or less than a predicted value (S53).

If it is determined in step S53 that the wear of the halogen heater 33 is equal to or less than the predicted value (YES in S53), the controller 124 sets the lower limit of the duty cycle of the PWM control to 10% (S55), and proceeds to step S59.

If it is determined in step S53 that the wear of the halogen heater 33 is not equal to or less than the predicted value (NO in S53), the controller 124 sets the lower limit of the duty cycle of the PWM control to 30% (S57), and proceeds to step S59.

In step S59, the controller 124 determines whether the printing is finished (S59).

If it is determined in step S59 that printing is not finished (NO in S59), the controller 124 proceeds to step S51.

If it is determined in step S59 that the printing is finished (YES in S59), the controller 124 ends the process.

The configurations and operations of the image forming apparatus 1 other than those described above are the same as those in the first embodiment, and thus description thereof will not be repeated.

According to the present embodiment, the control state for controlling the power supplied to the halogen heater 33 is switched, according to the extent of wear of the halogen heater 33, between the first control state in which the lower limit of the duty cycle of the PWM control is set to 30% and the second control state in which the lower limit of the duty cycle of the PWM control is set to 10%. Thus, decrease in the life of the halogen heater 33 can be effectively inhibited and ripple in the temperature of the fixing device 30 can be effectively suppressed.

In the present embodiment, it has been described that the reference state with which the actual wear rate of the halogen heater 33 is compared is the state in which the wear rate of the halogen heater 33 increases at a constant rate relative to the number of sheets printed by the image forming apparatus 1. However, in general image forming apparatuses 1, the halogen heater 33 is seldom replaced as a single unit and is often replaced together with the fixing device 30 (a unit that includes, for example, the halogen heater 33 and the heating roller 31 (fixing roller)).

Considering such circumstances, in a modification of the present embodiment, the actual wear rate of the halogen heater 33 may be compared with the wear rate of the fixing device 30.

The controller 124 calculates the wear rate of the fixing device 30 according to formula (2) or formula (3) below using the cumulative number of sheets printed by the image forming apparatus 1 or the cumulative drive distance of the fixing device 30.

Wear rate (%) of fixing device=cumulative number of sheets printed by image forming apparatus/cumulative number of sheets printed by image forming apparatus for which replacement of fixing device is considered necessary (2)

Wear rate (%) of fixing device=cumulative drive distance of fixing device/cumulative drive distance of fixing device for which replacement of fixing device is considered necessary (3)

It should be noted that the cumulative number of sheets printed by the image forming apparatus for which it is determined that replacement of the fixing device is necessary in formula (2) is, for example, 100,000 sheets.

In this modification, the controller 124 controls the power supplied to the halogen heater 33 by comparing the wear rate of the fixing device 30 calculated using formula (2) or formula (3) with the wear rate of the halogen heater 33 calculated using formula (1). Specifically, the controller 124 determines that the halogen heater 33 is not worn as much as predicted when the wear rate of the halogen heater 33 is less than the wear rate of the fixing device 30, and controls the power supplied to the halogen heater 33 in the second control state in which the lower limit of the duty cycle of the PWM control is set to 10%. On the other hand, the controller 124 determines that the halogen heater 33 is worn more than predicted when the wear rate of the halogen heater 33 is greater than the wear rate of the fixing device 30, and controls the power supplied to the halogen heater 33 in the first control state in which the lower limit of the duty cycle of the PWM control is set to 30%.

Fourth Embodiment

Figures 16A, 16B:
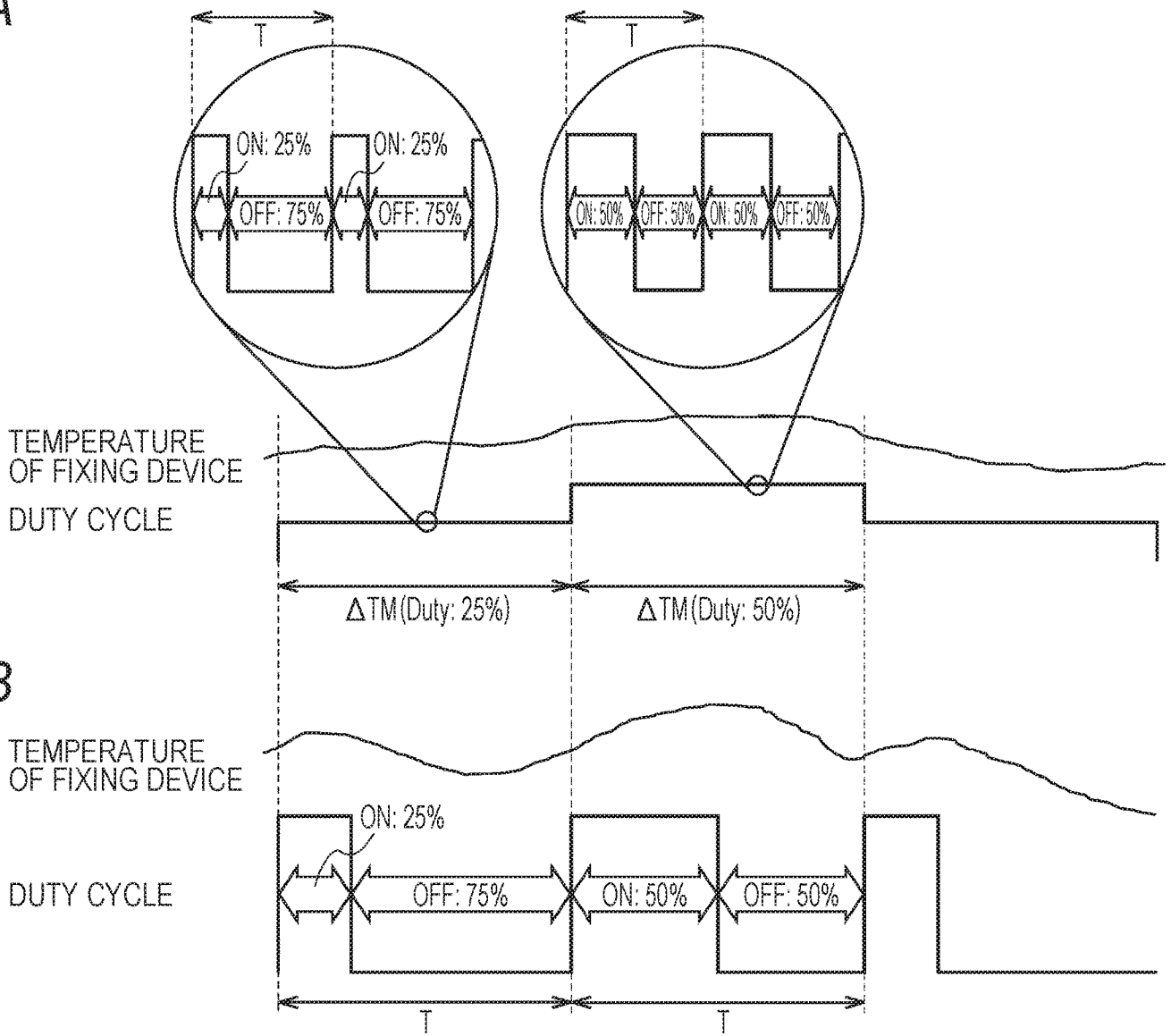
FIGS. 16A and 16B are diagrams showing a method of controlling power supplied to the halogen heater by the controller according to the first embodiment of the present invention versus a method of controlling power supplied to the halogen heater by the controller according to a fourth embodiment of the present invention.

FIGS. 16A and 16B are diagrams showing a method of controlling power supplied to the halogen heater 33 by the controller 124 according to the first embodiment of the present invention versus a method of controlling power supplied to the halogen heater 33 by the controller 124 according to a fourth embodiment of the present invention.

FIG. 16A is the method of controlling power supplied to the halogen heater 33 by the controller 124 according to the first embodiment of the present invention and FIG. 16B is the method of controlling power supplied to the halogen heater 33 by the controller 124 according to the fourth embodiment of the present invention.

Referring to FIG. 16A, in the first embodiment, the controller 124 controls the power supplied to the halogen heater 33 under PWM control. That is, the controller 124 sets the duty cycle based on the target controlled temperature of the fixing device 30 and the temperature of the fixing device 30 and performs the PWM control during a time ATM with a pulse train (cycle T) having the set duty cycle (25% in this case). Subsequently, the controller 124 sets the duty cycle based on the target controlled temperature of the fixing device 30 and the temperature of the fixing device 30 and performs the PWM control during the time ATM with a pulse train having the set duty cycle (50% in this case).

Referring to FIG. 16B, in the present embodiment, the controller 124 does not control the power supplied to the halogen heater 33 under PWM control. The controller 124 sets an appropriate duty cycle for each cycle based on the target controlled temperature of the fixing device 30 and the temperature of the fixing device 30 and performs a single on-and-off switching operation of the power supplied to the halogen heater 33 at the set duty cycle (duty cycle control). This single on-and-off switching operation of the power supplied to the halogen heater 33 corresponds to the control of one cycle T of the power supplied to the halogen heater 33. Specifically, the controller 124 sets the duty cycle to a first duty cycle (25% in this case) based on the target controlled temperature of the fixing device 30 and the temperature of the fixing device 30 and performs the single on-and-off switching operation of the power supplied to the halogen heater 33 at the first duty cycle. Subsequently, the controller 124 sets the duty cycle to a second duty cycle (50% in this case) based on the target controlled temperature of the fixing device 30 and the temperature of the fixing device 30 and performs the single on-and-off switching operation of the power supplied to the halogen heater 33 at the second duty cycle.

Similarly to the first embodiment, the controller 124 switches the control state (lower limit of the duty cycle to be set) for controlling the power supplied to the halogen heater 33 between the first control state and the second control state based on the timing at which a sheet enters the fixing device 30.

In the present embodiment, the controller 124 may set the duty cycle of the power supplied to the halogen heater 33 by the following method.

Figure 17:
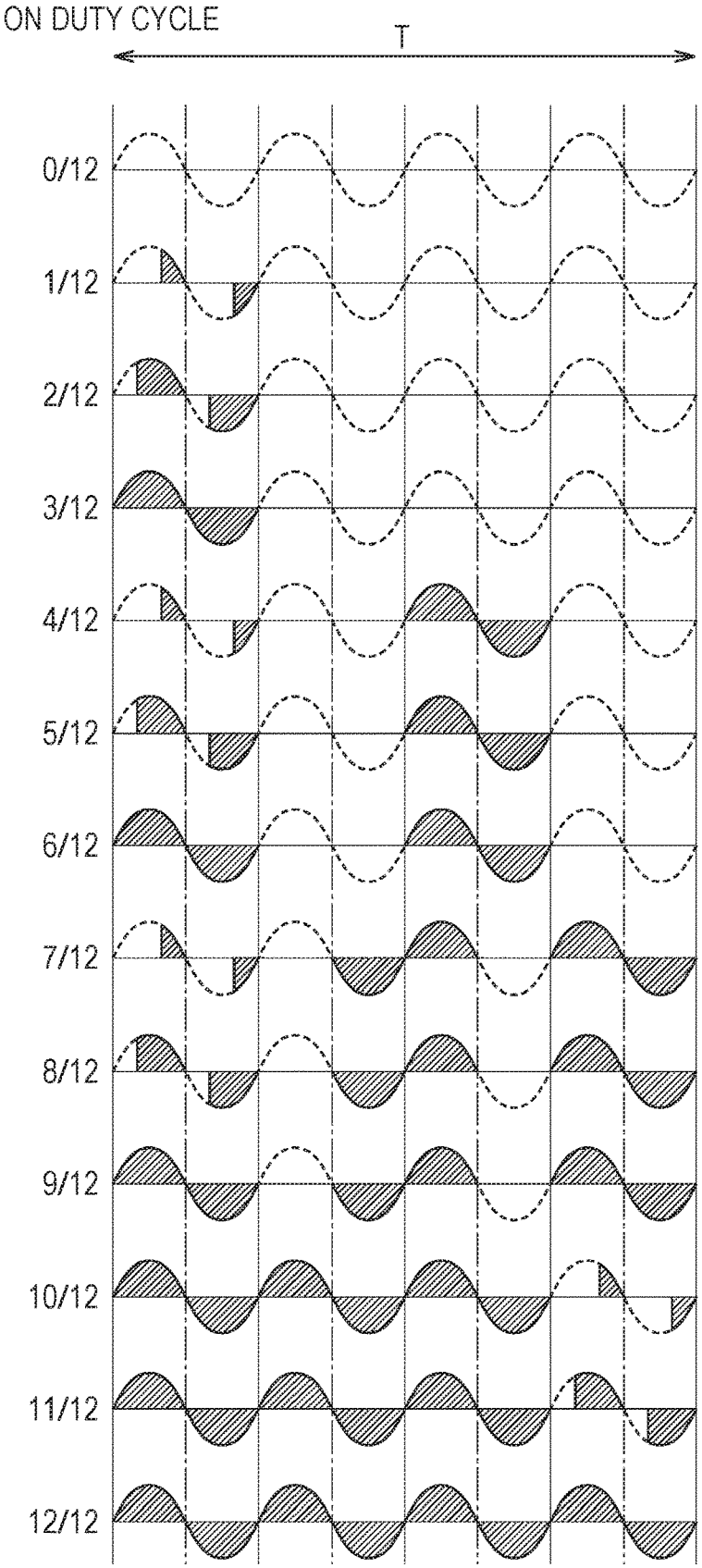
FIG. 17 is a diagram showing a method of setting the duty cycle of power supplied to the halogen heater according to the fourth embodiment of the present invention.

FIG. 17 is a diagram showing a method of setting the duty cycle of the power supplied to the halogen heater 33 according to the fourth embodiment of the present invention.

Referring to FIG. 17, a cycle T is composed of eight half waves (four full waves), and the duty cycle can be set to 13 levels starting from 0/12 to 12/12. For example, when the duty cycle is 4/12 (=about 33.3%), the duty cycle is set to 33.3% in a first half wave and a second half wave, to 100% in a fifth half wave and a sixth half wave, and to 0% in the other half waves. As a result, the duty cycle for the cycle T is about 33.3%.

The configurations and operations of the image forming apparatus 1 other than those described above are the same as those in the first embodiment, and thus description thereof will not be repeated.

According to the present embodiment, since PWM control is not used, decrease in the life of the halogen heater 33 can be inhibited and ripple in the temperature of the fixing device 30 can be suppressed with a simple configuration.

Fifth Embodiment

Figure 18:
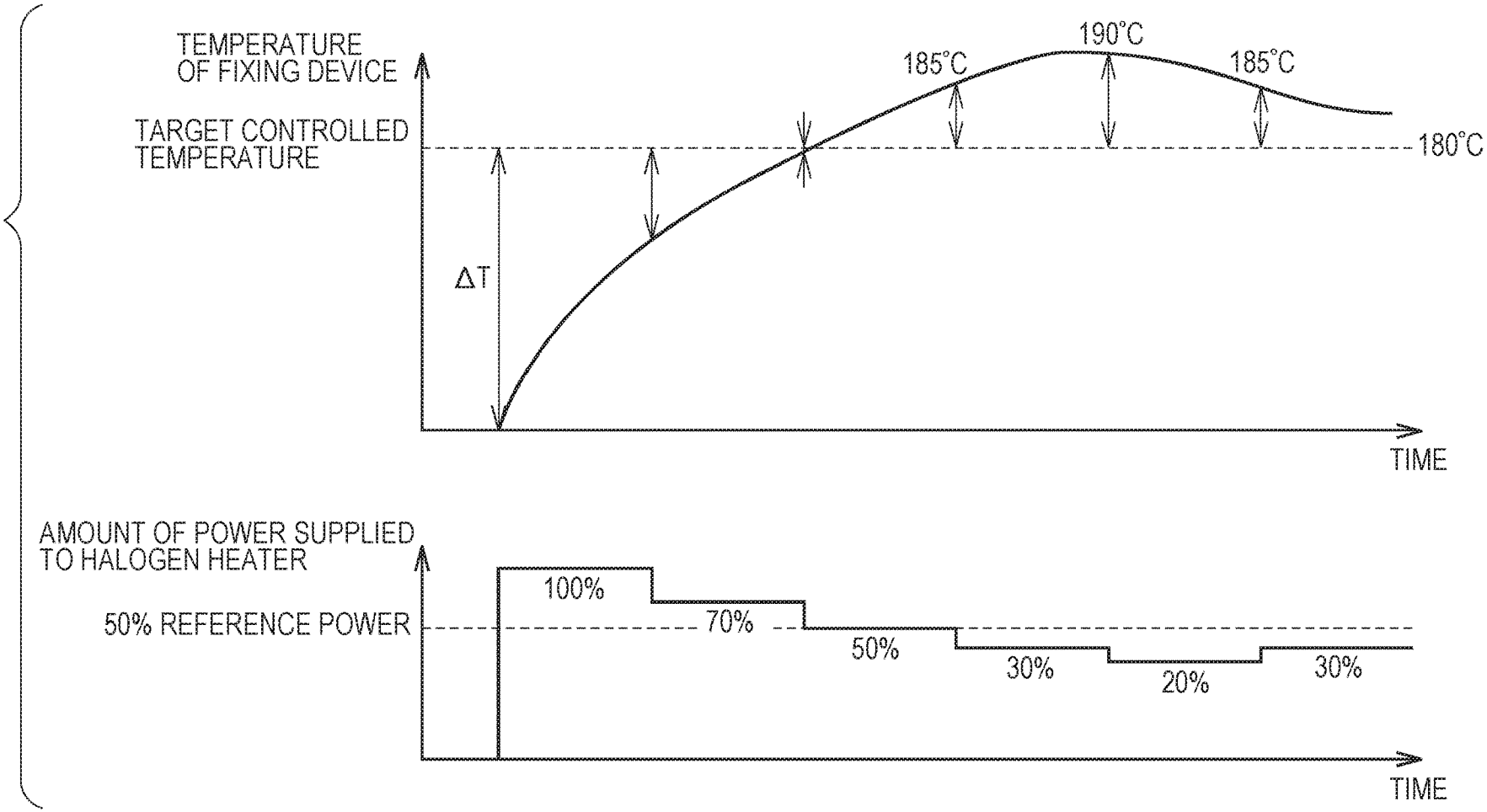
FIG. 18 is a diagram showing a method of controlling power supplied to the halogen heater by the controller according to a fifth embodiment of the present invention.

FIG. 18 is a diagram showing a method of controlling power supplied to the halogen heater 33 by the controller 124 according to a fifth embodiment of the present invention.

Referring to FIG. 18, in the present embodiment, the controller 124 does not control the power supplied to the halogen heater 33 under PWM control, nor does it perform on-off control of the power supplied to halogen heater 33. The controller 124 sets an amount of power (amount of induction heating (IH) power) for each cycle based on the target controlled temperature of the fixing device 30 and the temperature of the fixing device 30, and continuously supplies the set amount of power to the halogen heater 33 during the period of one cycle.

Here, the target controlled temperature is set to 180° C., and the amount of power supplied to the halogen heater 33 is expressed as a ratio (percentage) to the maximum amount of power. The amount of power supplied to the halogen heater 33 is set to a value higher than a 50% reference power when the temperature of the fixing device 30 is lower than the target controlled temperature and is set to a value lower than the 50% reference power when the temperature of the fixing device 30 is higher than the target controlled temperature.

Similarly to the first embodiment, the controller 124 switches the control state (lower limit of the amount of power to be set) for controlling the power supplied to the halogen heater 33 between the first control state in which the lower limit of the amount of power per cycle is set to the first value and the second control state in which the lower limit of the amount of power per cycle is set to the second value, based on the timing at which a sheet enters the fixing device 30.

The configurations and operations of the image forming apparatus 1 other than those described above are the same as those in the first embodiment, and thus description thereof will not be repeated.

According to the present embodiment, since there is no on-off control of the power supplied to the halogen heater 33, decrease in the life of the halogen heater 33 can be inhibited and ripple in the temperature of the fixing device 30 can be suppressed with a simple configuration.

However, in the PWM control such as that of the first embodiment, sudden changes in the temperature of the fixing device 30 occur less frequently and ripple in the temperature of the fixing device 30 is less likely to be caused because the power supplied to the halogen heater 33 is turned on and off at short intervals. Thus, the PWM control such as that of the first embodiment is more preferred than the control methods according to the fourth or fifth embodiment.

Others

The above-described embodiments can be combined as appropriate.

The process shown in the embodiments described above may be performed by software or by using a hardware circuit. It is also possible to provide a program for executing the process shown in the embodiments described above, and the program may be provided to users by recording the program on a recording medium such as a CD-ROM, a flexible disk, a hard disk, a ROM, a RAM, or a memory card. The program is executed by a computer such as a CPU.

Furthermore, the program may be downloaded to an apparatus via a communication line such as the Internet.

Although embodiments of the present invention have been described and illustrated in detail, the disclosed embodiments are made for purposes of illustration and example only and not limitation. The scope of the present invention should be interpreted by terms of the appended claims, and it is intended that all modifications within the meaning and scope equivalent to the claims are included.

What is claimed is:

1. An image forming apparatus comprising:

a fixer including a halogen heater; and a hardware processor that controls power supplied to the halogen heater, wherein the hardware processor switches, according to a state of the fixer, a control state for controlling the power supplied to the halogen heater between a first control state in which a lower limit of an amount of power per cycle of the power supplied to the halogen heater is set to a first value and a second control state in which the lower limit of the amount of power per cycle of the power supplied to the halogen heater is set to a second value lower than the first value, and wherein life of the halogen heater when an amount of power per cycle of the power supplied to the halogen heater is set to the second value is 80% or less of the life of the halogen heater when the amount of power per cycle of the power supplied to the halogen heater is set to the first value.

2. The image forming apparatus according to claim 1, wherein:

the hardware processor controls the power supplied to the halogen heater by controlling a duty cycle being a ratio of time to supply power to time of one cycle, and the first control state is a state in which a lower limit of the duty cycle is set to a first duty cycle lower limit, and the second control state is a state in which the lower limit of the duty cycle is set to a second duty cycle lower limit lower than the first duty cycle lower limit.

3. The image forming apparatus according to claim 2, wherein the hardware processor controls the power supplied to the halogen heater by pulse width modulation (PWM) control that changes a duty ratio of a pulse wave to perform modulation.

4. The image forming apparatus according to claim 1, wherein the hardware processor controls the power supplied to the halogen heater in the second control state during a predetermined time just before a first sheet to be printed in a print job executed by the image forming apparatus enters the fixer.

5. The image forming apparatus according to claim 1, wherein the hardware processor controls the power supplied to the halogen heater in the second control state when a target controlled temperature of the fixer is equal to or higher than a predetermined temperature.

6. The image forming apparatus according to claim 1, wherein the hardware processor switches the control state for controlling the power supplied to the halogen heater between the first control state and the second control state according to an extent of wear of the halogen heater.

7. The image forming apparatus according to claim 6, wherein the hardware processor comprises:

a wear calculator that calculates the extent of wear of the halogen heater based on a time during which the power supplied to the halogen heater is controlled in the first control state and a time during which the power supplied to the halogen heater is controlled in the second control state; and a wear controller that controls the power supplied to the halogen heater in the second control state when the extent of wear of the halogen heater calculated by the wear calculator is less than the extent of wear of the halogen heater predicted from the number of sheets printed by the image forming apparatus.

8. The image forming apparatus according to claim 7, wherein the wear controller controls the power supplied to the halogen heater in the first control state when the extent of wear of the halogen heater calculated by the wear calculator is greater than the extent of wear of the halogen heater predicted from the number of sheets printed by the image forming apparatus.

9. The image forming apparatus according to claim 6, wherein the hardware processor comprises:

a fixing calculator that calculates an extent of wear of the fixer;

a wear calculator that calculates the extent of wear of the halogen heater based on a time during which the power supplied to the halogen heater is controlled in the first control state and a time during which the power supplied to the halogen heater is controlled in the second control state; and a comparison controller that controls the power supplied to the halogen heater by comparing the extent of wear of the fixer calculated by the fixing calculator with the extent of wear of the halogen heater calculated by the wear calculator.

10. The image forming apparatus according to claim 6, further comprising a fixing condition changer that, when the hardware processor controls the power supplied to the halogen heater in the second control state, lowers a target controlled temperature of the fixer and delays a timing at which a sheet enters the fixer compared with when the hardware processor controls the power supplied to the halogen heater in the first control state.

11. A non-transitory recording medium storing a computer readable control program for an image forming apparatus comprising a fixer including a halogen heater, the computer readable control program causing a computer to perform controlling power supplied to the halogen heater, wherein in the controlling, a control state for controlling power supplied to the halogen heater is switched, according to a state of the fixer, between a first control state in which a lower limit of an amount of power per cycle of the power supplied to the halogen heater is set to a first value and a second control state in which the lower limit of the amount of power per cycle of the power supplied to the halogen heater is set to a second value lower than the first value, and wherein life of the halogen heater when an amount of power per cycle of the power supplied to the halogen heater is set to the second value is 80% or less of the life of the halogen heater when the amount of power per cycle of the power supplied to the halogen heater is set to the first value.

* * * * *